US005546614A

United States Patent [19]

King, II

[11] Patent Number: 5,546,614

[45] Date of Patent: Aug. 20, 1996

[54] REFUSE COLLECTOR DRAINPIPE INSERT

[76] Inventor: David E. King, II, 3270 Goldmaur Ct., No. B, Port Orchard, Wash. 98366

[21] Appl. No.: 328,945

[22] Filed: Oct. 25, 1994

Related U.S. Application Data

[63] Continuation of Ser. No. 88,660, Jul. 7, 1993, abandoned.

[51] Int. Cl.[6] ..... E03D 9/00

[52] U.S. Cl. ..... 4/256.1; 4/292; 4/DIG. 14; 210/497.1; 267/166.1

[58] Field of Search ..... 4/286–292, 652, 4/255.01, DIG. 14, 256.1; 210/497.1, 497.3, 460, 232; 267/166, 166.1, 167, 179, 180

[56] References Cited

U.S. PATENT DOCUMENTS

| | | | |
|---|---|---|---|
| 470,192 | 3/1892 | Gross | 210/497.3 X |
| 594,169 | 11/1897 | Catsiff | 4/DIG. 14 |
| 1,118,235 | 11/1914 | Rock | 4/286 X |
| 1,217,763 | 2/1917 | Hirrich | 4/DIG. 14 |
| 3,021,528 | 2/1962 | Hargrave | 4/256.1 X |
| 3,034,869 | 5/1962 | Peterson | 267/180 X |
| 4,051,839 | 10/1977 | Petry | 210/497.1 X |

FOREIGN PATENT DOCUMENTS

| | | | |
|---|---|---|---|
| 0921224 | 1/1947 | France | 4/292 |
| 0359157 | 9/1930 | United Kingdom | 4/291 |

*Primary Examiner*—Charles E. Phillips
*Attorney, Agent, or Firm*—Robert W. Beach

[57] ABSTRACT

A refuse-collecting drainpipe insert is a generally helical coil formed by a strip of rectangular cross section and having a bulge located axially generally centrally of the coil, and frustoconical end portions tapered oppositely from the central bulge of the coil, the strip at one end of the coil being formed as a hook and the strip at the other end of the coil being formed as a return bend.

1 Claim, 2 Drawing Sheets

Fig. 4
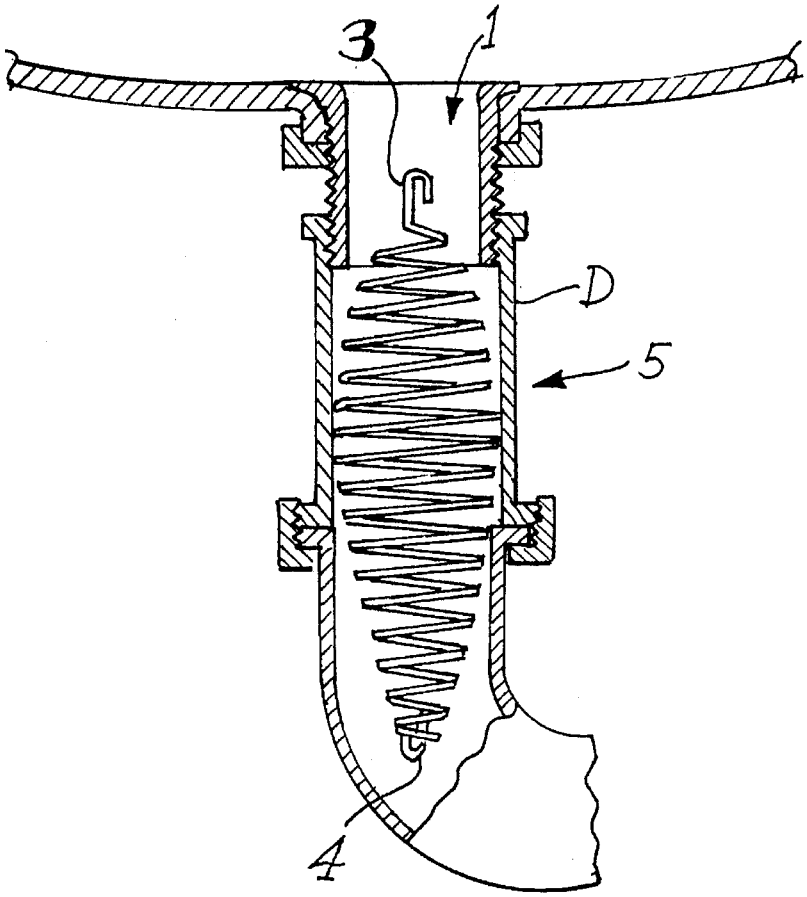
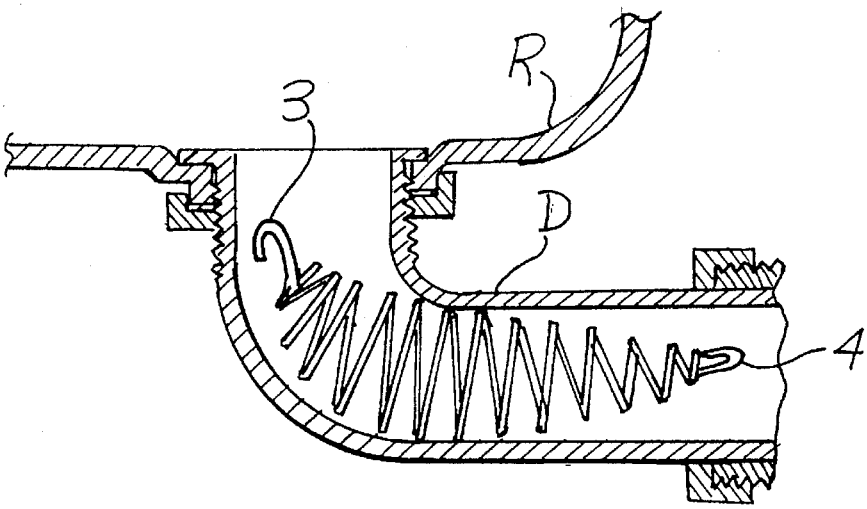
Fig. 5

REFUSE COLLECTOR DRAINPIPE INSERT

This is a continuation of application Ser. No. 08/088,660 filed on Jul. 7, 1993 now abandoned.

BACKGROUND OF THE INVENTION

1. Field of the Invention

The present invention relates to a refuse collector in the form of a drainpipe insert for insertion into drains from plumbing fixtures at locations adjacent to such fixtures.

2. Prior Art

The prior practice with respect to refuse in water discharged from plumbing fixtures such as shower stalls, bathtubs, washbowls and sinks has been to allow such refuse as was not carried through traps conventionally located in such plumbing fixture drains to be deposited in the traps until the traps were clogged or nearly clogged and then to clean out the traps either by use of some refuse solvent liquid, by use of a plunger force cup to force water through the drain trap and hopefully to dislodge some of the refuse from the drain trap, by reaming out refuse from the drain trap by the use of a plumber's snake or auger, or by disconnecting the trap from the drain line and digging out the refuse deposited in it. All of these procedures have been time-consuming and frequently have required the services of a plumber when the householder has been unable to unclog the drain sufficiently.

SUMMARY OF THE INVENTION

It is a principal object of the present invention to remove refuse from water draining from a plumbing fixture at a location adjacent to such fixture and prior to the drainage water reaching the trap in the fixture drain line.

Another object is to enable the refuse removed from drainage water adjacent to a plumbing fixture to be removed from the drain line quickly and easily.

A further object is to enable the refuse removed from the drainage water at a location adjacent to a plumbing fixture to be removed from the drain line without requiring the use of tools except for such tools as may be required to remove a strainer at the entrance to the drainpipe.

Another object is to control the flow of water draining from a plumbing fixture so as to promote the removal of refuse from such drainage water at a predetermined location.

The foregoing objects can be accomplished by locating a refuse-collecting insert in the drainpipe adjacent to a plumbing fixture, which insert can be removed readily from the drainpipe by withdrawing it into the plumbing fixture.

BRIEF DESCRIPTION OF THE DRAWINGS

FIG. 4 is a longitudinal section through a drain and a portion of a plumbing fixture showing the insert in side elevation installed in the drainpipe;

FIG. 5 is a vertical section through a portion of a drainpipe and a plumbing fixture of a type different from that shown in FIG. 4 and showing the refuse-collecting insert in side elevation installed in such drainpipe.

DETAILED DESCRIPTION

In plumbing systems, waste water is discharged from a plumbing fixture P through a drainpipe D leading downward from the fixture. The fixture may be a shower stall, a bathtub, a washbowl or a kitchen sink. It is customary for the drainpipe D to have in it a P-trap located a short distance from the fixture which takes the form of a return bend with the bend below the ends of the bend, i.e., the intake end of the bend opens upwardly and is connected to the fixture drain D as shown in FIG. 4 and the other end of the return bend leads to the outlet of the P-trap. Such bend forms a seal containing drainage water to prevent escape of sewer gas into the building through the drainpipe. The turbulence created by flow of drainage water through the P-trap tends to cause refuse carried by the drainage water to be precipitated out of the drainage water and to collect in the P-trap. When sufficient refuse has collected in the P-trap to clog it or substantially clog it, action is required to unclog the trap or to reduce the clog in the trap.

Traps in drainpipes connected to a shower stall or bathtub are more prone to become clogged than traps in drainpipes from other fixtures because the refuse carried by the waste water is principally body hair which tends to collect soap and grease so as eventually to form a plug. Customary procedures for unplugging the drainpipe include use of solvents for dissolving the soap and grease or mechanical devices such as a plumber's snake or an auger to ream out a passage through the plug. Sometimes the plug can be forced through the trap into the drainpipe leading to the sewer by applying hydraulic pressure to the plug by the use of a plunger which is a rubber suction cup attached to a wooden handle to free plumbing traps of minor obstructions. In extreme cases it may be necessary to remove the P-trap from the drainpipe so that it can be cleaned out by direct probing and scraping.

The purpose of the present invention is to deter the clogging of P-traps by relocating the location at which refuse is removed from drainage water. Such location is between the drain opening from the plumbing fixture and the P-trap and adjacent to the plumbing fixture. Such refuse removal location is established by lodging in the drainpipe a refuse collector in the form of a substantially open coil or helix, that is, the adjacent convolutions of the coil are spaced apart axially a considerable distance. Preferably the strip 2 of which such coil is made is of rectangular cross section as shown in FIG. 3 rather than being of circular cross section.

One end of the helical coil terminates in a hook 3, which end can be the upper end of the insert when lodged in a drainpipe. Such hook can be engaged by a loop or another hook enabling the insert to be pulled upward out of the drainpipe into the plumbing fixture. The other end of the coil insert strip can be formed as a return bent tip 4 located generally centrally of such coil end.

Figure 1:
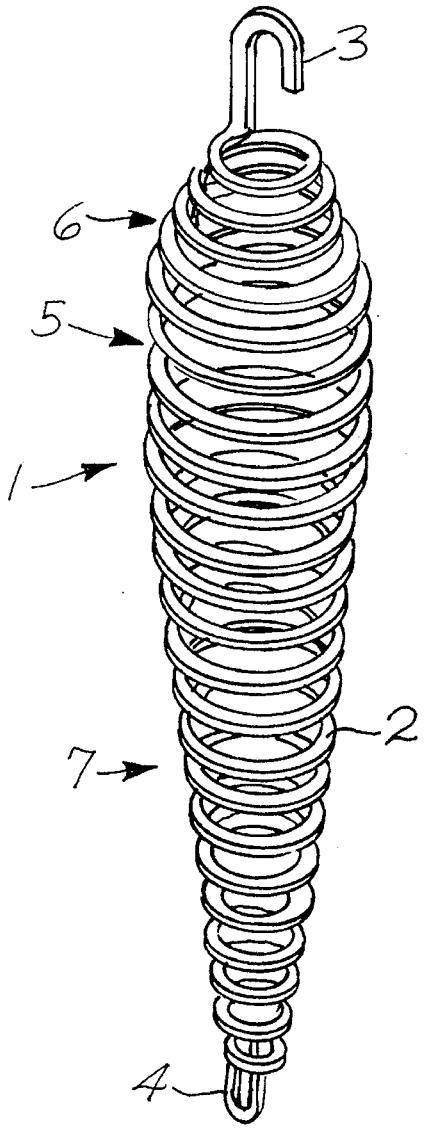
FIG. 1 is a top perspective of a refuse-collecting insert in accordance with the present invention.
Figure 2:
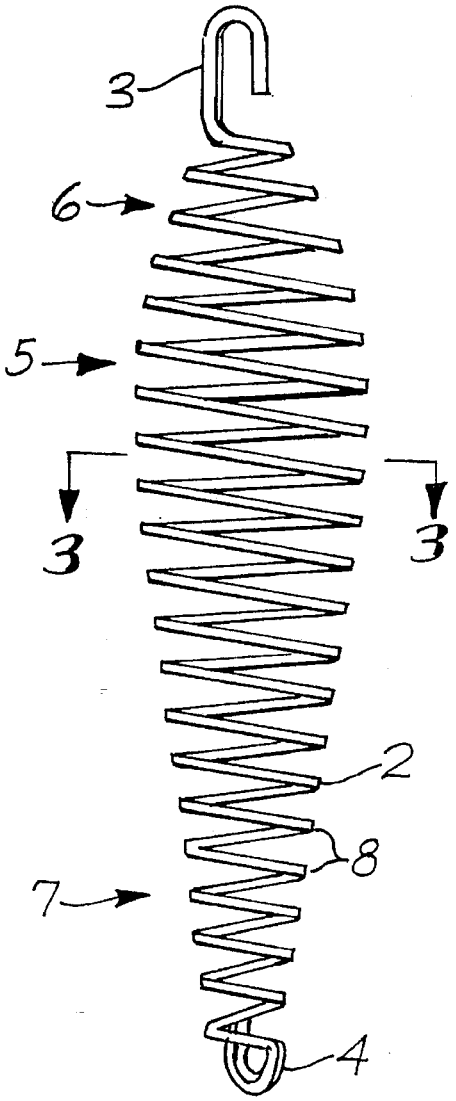
FIG. 2 is a side elevation of the refuse-collecting insert.

The generally helical coil is not precisely cylindrical but is double-tapered toward its opposite ends from the bulge 5 located axially generally centrally of the coil and has an empty interior hollow. It is preferred that the bulge 5 be located somewhat closer to the end of the coil carrying the hook 3 to provide a shorter generally frustoconical upwardly tapered tapered section 6. The portion of the coil between the bulge 5 and the return bent tip 4 carried by the other end of the coil also is preferably frustoconical to provide a longer downwardly tapered coil section 7. The combined lengths of the upwardly tapered coil section 6 and of the downwardly tapered coil section 7 constitute the major portion of the length of the coil as shown in FIG. 2.

Figure 3:
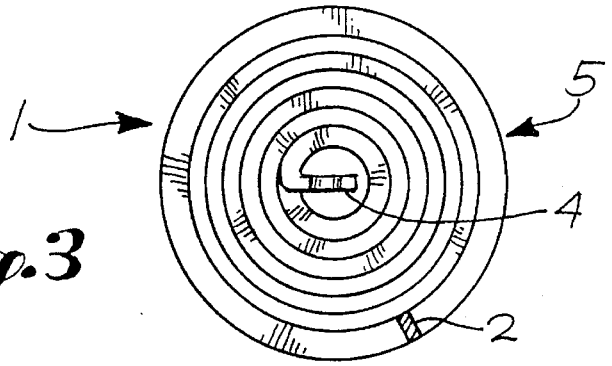
FIG. 3 is a transverse section through the refuse-collecting insert taken on line 3—3 of FIG. 2.

The degree of taper of the shorter tapered section 6 and of the longer tapered section 7 preferably is such with respect to the radial width of the strip 2 forming the coil that the convolutions of the coil are in partially radially overlapping or edge-overlapping relationship so that the coil has only a very limited linear passage through its central portion as shown in the sectional view of FIG. 3.

The cross-section size of drainpipe plumbing fixtures is rather standard, usually having an internal diameter of 1¼ inches. The insert 1 should be made of a size enabling its bulge 5 to fit snugly in the drainpipe D with a friction fit so that the flow of waste water will not be able to wash the insert down the drainpipe after it has been set in its desired location.

Because the coil convolutions 8 overlap radially to limit linear flow through the insert, the waste water flows principally along the outer side of the upper tapered section 6 and then into the interior hollow of the insert through the spaces between the coil convolutions until the drain water has passed the bulge 5. Then the drain water will flow principally out of the interior hollow of the insert through the spaces between the coil convolutions in the tapered lower section 7. The resulting sinuous flow and the turbulence which such flow creates will promote the entanglement of refuse, particularly hair, in the convolutions of first the upwardly tapered section 6 and then of the downwardly tapered section 8 of the coil 1 to remove such refuse from the drainage water.

The flow of drainage water through the drainpipe tends to maintain at least a small opening for passage of the water through the coil insert. The opening through the lower end of such insert will tend to clog first and, when the flow of drainage water becomes too restricted, it is a comparatively simple matter to remove the screen over the drain outlet from the plumbing fixture, if any, engage the hook 3 of the insert with a loop or a hook and apply a pull on the insert for removing it upward out of the drainpipe into the plumbing fixture. The refuse, principally hair and grease and soap collected on the insert, can be removed from the spaces between the coil convolutions quite easily. The cleaned insert can then be pushed back down through the drain opening to its desired location for again collecting refuse removed from the drainage water before it reaches the P-trap.

FIG. 4 shows a relatively long coupling between the plumbing fixture P and the P-trap, and FIG. 5 shows an elbow in the drainpipe close-coupled to the plumbing fixture. The helical coil insert is sufficiently bendable so that it can be inserted around the bend of the drainpipe elbow as shown in FIG. 5 to be lodged in such elbow upstream from the P-trap.

I claim:

1. A refuse-collecting insert adapted to be lodged in a drainpipe connected to the drain opening from a plumbing fixture for discharge therethrough of waste water carrying refuse and removable from the drainpipe upward through such drain opening, comprising a generally helical open coil having refuse-entangling convolutions forming an interior hollow and a bulge located axially spaced from the opposite ends of said coil of a size to fit snugly in the drainpipe, and said coil having a section tapered upwardly from said bulge for flow of waste water in the drainpipe from the exterior of said coil through the spaces between the refuse-entangling convolutions of said upwardly tapered section into the interior hollow of said coil and having a section tapered downwardly from said bulge for flow of waste water out of the interior hollow of said coil through the spaces between the refuse-entangling convolutions of said downwardly tapered section, said downwardly tapered section being longer than said upwardly tapered section, the combined lengths of said tapered sections constituting the major portion of the length of said coil, and the adjacent convolutions of a tapered section being in partially edge-overlapping relationship radially of the coil.

* * * * *